US008406683B2

(12) United States Patent
Oesterling

(10) Patent No.: US 8,406,683 B2
(45) Date of Patent: Mar. 26, 2013

(54) METHOD AND SYSTEM FOR INITIATING A VEHICLE DATA UPLOAD FUNCTION AT A PLURALITY OF MOBILE VEHICLES

(75) Inventor: Christopher L. Oesterling, Troy, MI (US)

(73) Assignee: General Motors LLC, Detroit, MI (US)

( * ) Notice: Subject to any disclaimer, the term of this patent is extended or adjusted under 35 U.S.C. 154(b) by 2308 days.

(21) Appl. No.: 10/756,086

(22) Filed: Jan. 13, 2004

(65) Prior Publication Data

US 2004/0142659 A1 Jul. 22, 2004

Related U.S. Application Data

(63) Continuation-in-part of application No. 10/115,321, filed on Apr. 3, 2002, now Pat. No. 7,142,810.

(51) Int. Cl.
*H04H 20/74* (2008.01)

(52) U.S. Cl. ..... 455/3.02; 340/870.01; 340/445

(58) Field of Classification Search ..... 455/3.02, 455/3.03, 3.05, 3.06, 426.1, 412.1, 456.1, 455/404.2, 421, 9, 67.11, 95–99, 152.1, 238.1, 455/297, 345, 346, 569.2, 575.9; 701/13, 701/29, 32, 211, 300; 342/357.07; 340/315, 340/870.43, 870.13, 870.05, 445, 870.27, 340/855.3, 853.1, 870.01, 853.8
See application file for complete search history.

(56) References Cited

U.S. PATENT DOCUMENTS

| | | | | |
|---|---|---|---|---|
| 6,385,532 | B1 * | 5/2002 | Dance et al. | 701/207 |
| 6,704,564 | B1 * | 3/2004 | Lange et al. | 455/412.1 |
| 6,895,310 | B1 * | 5/2005 | Kolls | 701/1 |
| 6,912,396 | B2 * | 6/2005 | Sziraki et al. | 455/456.1 |
| 2001/0002822 | A1 * | 6/2001 | Watters et al. | 342/357.1 |
| 2002/0049535 | A1 * | 4/2002 | Rigo et al. | 701/211 |
| 2002/0065037 | A1 * | 5/2002 | Messina et al. | 455/12.1 |
| 2002/0085588 | A1 * | 7/2002 | Giaccherini et al. | 370/487 |
| 2002/0120728 | A1 * | 8/2002 | Braatz et al. | 709/223 |
| 2003/0185406 | A1 * | 10/2003 | Goodman et al. | 381/86 |
| 2004/0023645 | A1 * | 2/2004 | Olsen et al. | 455/418 |
| 2005/0014487 | A1 * | 1/2005 | Kobayashi et al. | 455/412.1 |

* cited by examiner

*Primary Examiner* — Dominic E Rego
(74) *Attorney, Agent, or Firm* — Anthony Luke Simon; Reising Ethington P.C.

(57) ABSTRACT

A system and method of initiating a vehicle data upload function at a plurality of mobile vehicles. A satellite radio system broadcast channel is monitored for a call center initiated vehicle data upload command signal at the plurality of mobile vehicles. A determination is made, at the plurality of mobile vehicles, whether the vehicle data upload command signal corresponds to a mobile vehicle. The vehicle data upload command signal is extracted from the broadcast channel based on the determination. A vehicle data upload function is performed based on the extracted vehicle data upload command signal. The method further comprises determining the plurality of mobile vehicles at a call center based on a service criterion. A computer usable medium is with suitable computer program code is employed for of initiating a vehicle data upload function at a plurality of mobile vehicles.

20 Claims, 5 Drawing Sheets

METHOD AND SYSTEM FOR INITIATING A VEHICLE DATA UPLOAD FUNCTION AT A PLURALITY OF MOBILE VEHICLES

CROSS REFERENCE TO RELATED APPLICATION

This application is a continuation-in-part to U.S. patent application Ser. No. 10/115,321, filed Apr. 3, 2002 now U.S. Pat. No. 7,142,810, which is incorporated herein by reference in its entirety.

FIELD OF THE INVENTION

This invention relates generally to data transmissions over a wireless communication system. More specifically, the invention relates to a method and system for initiating a vehicle data upload function, at a plurality of mobile vehicles, using a satellite radio broadcast system.

BACKGROUND OF THE INVENTION

Wireless communication services for mobile vehicles, such as navigation and roadside assistance, have increased rapidly in recent years. Most of the available services apply to a motor vehicle in operation, but more recently, the demands and potential for services to a turned-off vehicle have grown. Services requested while the vehicle is off or in a quiescent mode include maintenance and diagnostic functions, system updates, vehicle position determination, unlocking of the doors, or vehicle alarm setting and silencing.

Normally when the mobile vehicle equipped with a telematics unit or vehicle communication device is turned off, equipment is placed into a powered-down or sleep mode. This sleep or discontinuous-receive mode includes, for example, a time when the vehicle communication device is scheduled to awaken and the duration for the vehicle communication device to be awake. The discontinuous-receive mode includes storing information such as time and vehicle location at the initiation of the sleep mode. The discontinuous-receive mode includes setting a time for the next wakening period, and a duration for the next service-ready mode. The discontinuous-receive mode also includes actions to place other systems in the mobile vehicle into a quiescent or powered-down mode, including for example the vehicle communications device, the telematics unit, or both. While powered down, the vehicle communication device checks an on-board clock or timer to determine when it is time to awaken.

A communication device and a telematics unit are placed into a powered-down mode for minimal power drain on the battery. To perform a requested function while the ignition is off, the vehicle is awakened, the desired function performed, and the vehicle placed back into the sleep mode.

One method currently in use is to synchronize the wake-up time with an incoming call from a telematics or service call center. When the vehicle is awakened, a call is received and responded to appropriately. The time period between wake-up operations varies from ten minutes, to several days or more if the vehicle has not been moved or driven for a while. To coordinate the wake-up function with the call from the call center, time at the call center and at the mobile vehicle needs to be synchronized. A global positioning system (GPS) unit in the mobile vehicle provides an accurate reading of time. After the call is received and the vehicle responds, the vehicle is put back into the sleep mode again after a predetermined duration, minimizing battery drain.

Unfortunately, a prescribed wake-up schedule will not always accommodate the immediate needs of the user or service subscriber. A vehicle in long-term parking at an airport, for example, has been powered down for a while, but requires immediate telematics assistance when the owner returns to a vehicle with keys locked inside. When a vehicle is stolen, for example, a vehicle owner will want to retrieve vehicle location information quickly.

A method with a quicker response time is needed to make vehicle services available when the vehicle is powered down or turned off. This would result in increased subscriber satisfaction with telematics services. Increased availability and timeliness of services is compromised by the need to maintain low power consumption. The method would improve the availability of a vehicle to receive and perform a service request, while maintaining low power consumption.

It is an object of this invention, therefore, to provide a method for improving the availability of a quiescent vehicle to receive and perform a service request, and to overcome the deficiencies and obstacles described above.

SUMMARY OF THE INVENTION

A method of initiating a vehicle data upload function at a plurality of mobile vehicles. A satellite radio system broadcast channel is monitored for a call center initiated vehicle data upload command signal at the plurality of mobile vehicles. A determination is made, at the plurality of mobile vehicles, whether the vehicle data upload command signal corresponds to a mobile vehicle. The vehicle data upload command signal is extracted from the broadcast channel based on the determination. A vehicle data upload function is performed based on the extracted vehicle data upload command signal. The method further comprises determining the plurality of mobile vehicles at a call center based on a service criterion.

A computer usable medium including computer program code for initiating a vehicle data upload function at a plurality of mobile vehicles, comprising: computer program code for monitoring a satellite radio system broadcast channel for a call center initiated vehicle data upload command signal at the plurality of mobile vehicles. The medium further includes computer program code for determining at the plurality of mobile vehicles whether the vehicle data upload command signal corresponds to a mobile vehicle and computer program code for extracting the vehicle data upload command signal from the broadcast channel based on the determination Additionally, the medium includes computer program code for performing a vehicle data upload function based on the extracted vehicle data upload command signal. The computer usable medium further comprises computer program code for determining the plurality of mobile vehicles at a call center based on a service criterion.

A system including means for initiating a vehicle data upload function at a plurality of mobile vehicles, comprising: means for monitoring a satellite radio system broadcast channel for a call center initiated vehicle data upload command signal at the plurality of mobile vehicles. The system further includes means for determining at the plurality of mobile vehicles whether the vehicle data upload command signal corresponds to a mobile vehicle and means for extracting the vehicle data upload command signal from the broadcast channel based on the determination. Additionally, the system includes means for performing a vehicle data upload function based on the extracted vehicle data upload command signal.

The system further comprises means for determining the plurality of mobile vehicles at a call center based on a service criterion.

DETAILED DESCRIPTION OF THE PRESENTLY PREFERRED EMBODIMENTS

Figure 1:
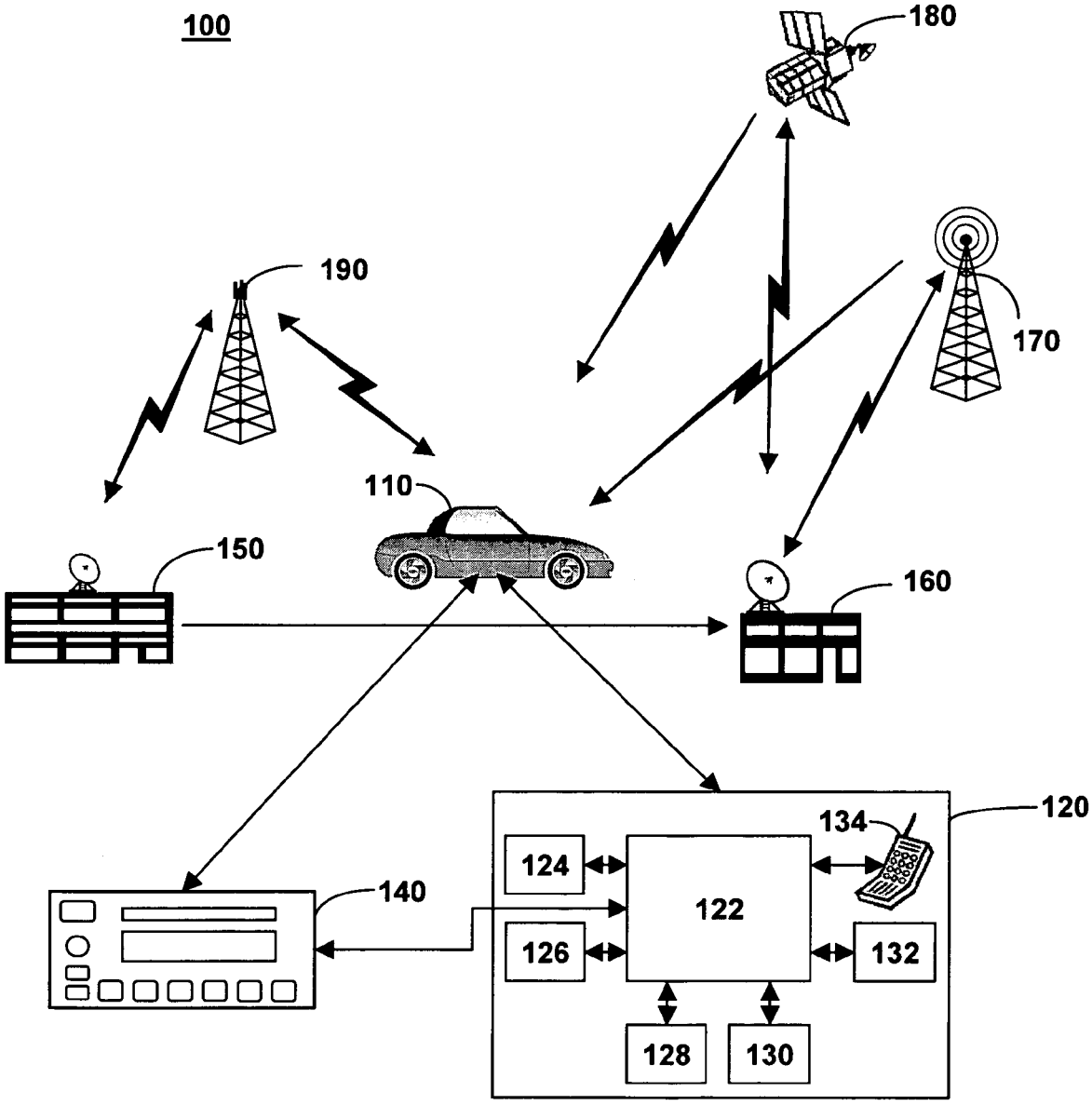
FIG. 1 is an illustration of one embodiment of a system for accessing a quiescent mobile vehicle equipped with a telematics unit and a satellite radio, in accordance with the current invention.

FIG. 1 illustrates one embodiment of a system for accessing a quiescent mobile vehicle equipped with a telematics unit and a satellite radio receiver, in accordance with the present invention at 100. The invention leverages the infrastructure of a satellite radio system to communicate with a telematics unit of a mobile vehicle, requesting the in-vehicle phone to call a telematics service call center or to perform another function. A satellite radio in a quiescent mobile vehicle monitors a broadcast channel and receives a broadcasted message requesting an in-vehicle phone to call a telematics call center. The telematics unit is awakened from a powered-down state so that it call a telematics call center, establish bi-directional communications, and perform a requested telematics service.

Mobile vehicle access system 100 includes a mobile vehicle 110, a telematics unit 120, a satellite radio receiver 140, one or more telematics service call centers 150, one or more satellite radio service uplink facilities 160, one or more terrestrial radio transmitters 170, one or more satellite radio service geostationary satellites 180, a cellular phone network, and a wireless carrier system 190.

Mobile vehicle 110 is a vehicle equipped with suitable hardware and software for transmitting and receiving voice and data communications. Mobile vehicle 110 contains telematics unit 120. Telematics unit 120 includes a digital signal processor (DSP) 122 connected to a wireless analog, digital or dual-mode modem 124, a global positioning system (GPS) unit 126, an in-vehicle memory 128, a microphone 130, one or more speakers 132, and a network access device (NAD) or in-vehicle mobile phone 134. In-vehicle mobile phone 134 is an analog, digital, or dual-mode cellular phone. GPS unit 126 provides, for example, longitude and latitude coordinates of the vehicle.

DSP 122 uses instructions and data from a computer usable medium that contain various computer programs for controlling programming and operational modes within mobile vehicle 110. Digital signals activate the programming mode and operation modes, as well as provide input and output data.

Satellite radio receiver 140 is any suitable hardware for receiving satellite radio broadcast signals in mobile vehicle 110. Satellite radio receiver 140 receives digital signals from a terrestrial radio transmitter 170 or a satellite radio service geostationary satellite 180. Satellite radio receiver 140 includes a radio receiver for receiving broadcast radio information over one or more channels. Satellite radio receiver 140 generates audio output. Satellite radio receiver 140 can be embedded within telematics unit 120 or can be a separate component connected to the telematics unit 120, as shown. Satellite radio receiver 140 provides channel and signal information to telematics unit 120. Telematics unit 120 monitors, filters and sends signals that are received from satellite broadcasts, radio broadcasts or other wireless communication systems to output devices such as speaker 132 and visual display devices.

Telematics service call center 150 is a location where many calls are received and serviced at the same time, or where many calls are sent at the same time. The call center prescribes communications to and from mobile vehicle 110. Telematics service call center 150 is a voice call center, providing verbal communications between an advisor in the call center and a subscriber in a mobile vehicle. Telematics service call center 150 contains one or more switches, one or more data transmission devices, one or more communication services managers, one or more communication services databases, one or more real or virtual advisors, and one or more bus systems.

When telematics service call center 150 receives a request from a telematics subscriber that requires communication with a powered-down or quiescent mobile vehicle, telematics service call center 150 sends command information to satellite radio uplink facility 160 that includes a request for telematics unit 120 to call the telematics service call center 150.

As part of a satellite broadcast system, a satellite radio uplink facility 160 sends and receives radio signals from a geostationary satellite 180. Satellite radio uplink facility 160 uplinks command information from telematics service call center 150 to one or more terrestrial radio transmitters 170. Satellite radio uplink facility 160 also sends the command and other radio signals to geostationary satellite 180.

Terrestrial radio transmitter 170 and geostationary satellite 180 transmits radio signals to satellite radio receiver 140 in mobile vehicle 110. Terrestrial radio transmitter 170 and geostationary satellite 180 broadcasts, for example, over a spectrum in the "S" band (2.3 GHz) that has been allocated by the U.S. Federal Communications Commission (FCC) for nationwide broadcasting of satellite-based Digital Audio Radio Service (DARS). The broadcast is, for example, a 120 kilobit-per-second portion of the bandwidth designated for command signals from telematics service call center 150 to mobile vehicle 110.

Broadcast transmissions provided by a satellite radio broadcast system are sent from geostationary satellite 180 or terrestrial radio transmitter 170 to satellite radio receiver 140. In addition to music and entertainment, traffic information, road construction information, advertisements, news and information on local events, a command signal is sent to satellite radio receiver 140 to awaken telematics unit 120 with a request for in-vehicle mobile phone 134 to call telematics service call center 150. Telematics unit 120 monitors satellite radio system broadcast signals received by satellite radio receiver 140 for a command signal, and when a command signal is detected, the command signal and information is extracted from the broadcast channel. Telematics unit 120 retrieves data and information from the audio signals of satellite radio receiver 140.

The command signal includes a request for telematics unit 120 to call telematics service call center 150. In response, telematics unit 120 places a call with in-vehicle mobile phone 134 via wireless carrier system 190.

Wireless carrier system 190 is a wireless communications carrier. Wireless carrier system 190 is, for example, a mobile telephone system. The mobile telephone system is an analog mobile telephone system operating over a prescribed band nominally at 800 MHz. The mobile telephone system is a digital mobile telephone system operating over a prescribed band nominally at 800 MHz, 900 MHz, 1900 MHz, or any suitable band capable of carrying mobile communications. Wireless carrier system 190 transmits to and receive signals from mobile vehicle 110. Wireless carrier system 190 is connected with other communication and landline networks. Telematics service call center 150 is connected to wireless carrier system 190 with a land-based network, a wireless network, or a combination of landline and wireless networks.

Figure 1A:
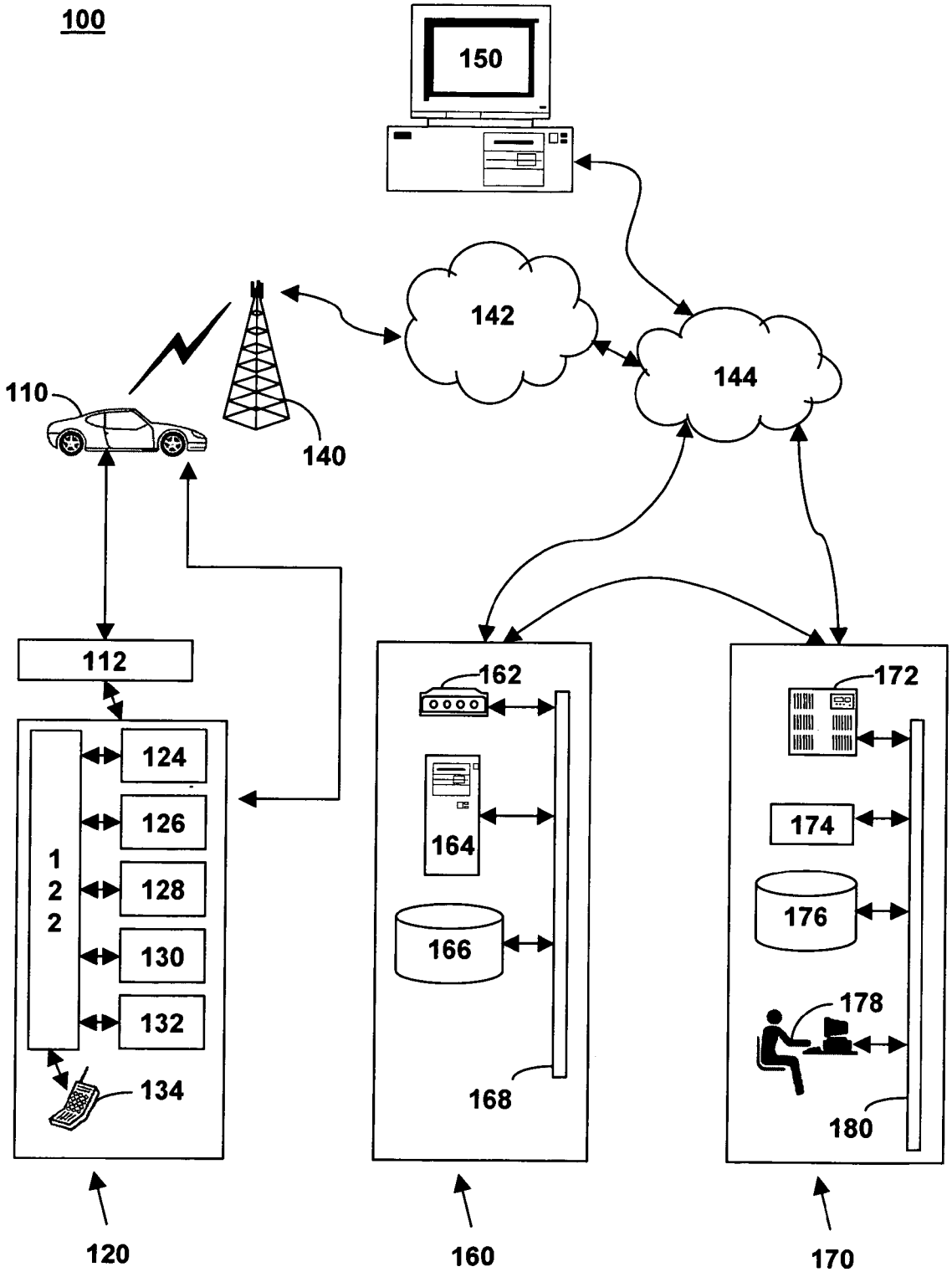
FIG. 1A is an illustration of another embodiment of a system for accessing a quiescent mobile vehicle equipped with a telematics unit and a satellite radio, in accordance with the current invention.

FIG. 1A illustrates one embodiment of system for data transmission over a wireless communication system, in accordance with the present invention at 100. Mobile vehicle communication system (MVCS) 100 includes a mobile vehicle communication unit (MVCU) 110, a vehicle communication network 112, a telematics unit 120, one or more wireless carrier systems 140, one or more communication networks 142, one or more land networks 144, one or more client, personal or user computers 150, one or more web-hosting portals 160, and one or more call centers 170. In one embodiment, MVCU 110 is implemented as a mobile vehicle equipped with suitable hardware and software for transmitting and receiving voice and data communications. MVCS 100 may include additional components not relevant to the present discussion. Mobile vehicle communication systems and telematics units are known in the art.

MVCU 110 may also be referred to as a mobile vehicle throughout the discussion below. In operation, MVCU 110 may be implemented as a motor vehicle, a marine vehicle, or as an aircraft. MVCU 110 may include additional components not relevant to the present discussion.

MVCU 110, via a vehicle communication network 112, sends signals to various units of equipment and systems (detailed below) within MVCU 110 to perform various functions such as unlocking a door, opening the trunk, setting personal comfort settings, and calling from telematics unit 120. In facilitating interactions among the various communication and electronic modules, vehicle communication network 112 utilizes network interfaces such as controller-area network (CAN), International Organization for Standardization (ISO) Standard 9141, ISO Standard 11898 for high-speed applications, ISO Standard 11519 for lower speed applications, and Society of Automotive Engineers (SAE) Standard J1850 for high-speed and lower speed applications. Vehicle network 112 may also be referred to as a vehicle bus.

MVCU 110, via telematics unit 120, sends and receives radio transmissions from wireless carrier system 140. Wireless carrier system 140 is implemented as any suitable system for transmitting a signal from MVCU 110 to communication network 142.

Telematics unit 120 includes a digital signal processor (DSP) 122 connected to a wireless modem 124, a global positioning system (GPS) unit 126, an in-vehicle memory 128, a microphone 130, one or more speakers 132, and a network access device (NAD) or an embedded or in-vehicle mobile phone 134. In other embodiments, telematics unit 120 may be implemented without one or more of the above listed components, such as, for example speakers 132. Telematics unit 120 may include additional components not relevant to the present discussion.

In one embodiment, DSP 122 is implemented as a microcontroller, controller, host processor, or vehicle communications processor. In an example, DSP 122 is implemented as an application specific integrated circuit (ASIC). In another embodiment, DSP 122 is implemented as a processor working in conjunction with a central processing unit (CPU) performing the function of a general purpose processor. GPS unit 126 provides longitude and latitude coordinates of the vehicle responsive to a GPS broadcast signal received from one or more GPS satellite broadcast systems (not shown). In-vehicle mobile phone 134 is a cellular-type phone, such as, for example an analog, digital, dual-mode, dual-band, multi-mode or multi-band cellular phone.

DSP 122 executes various computer programs that affect operational modes of electronic and mechanical systems within MVCU 110. DSP 122 controls communications (e.g. call signals) between telematics unit 120, wireless carrier system 140, and call center 170. In one embodiment, a voice-recognition application is installed in DSP 122 that can translate human voice input through microphone 130 to digital signals. DSP 122 generates and accepts digital signals transmitted between telematics unit 120 and a vehicle communication network 112 that is connected to various electronic modules in the vehicle. In one embodiment, these digital signals activate the programming mode and operation modes, as well as provide for data transfers. In this embodiment, signals from DSP 122 are translated into voice messages and sent out through speaker 132.

Communication network 142 includes services from one or more mobile telephone switching offices and wireless networks. Communication network 142 connects wireless carrier system 140 to land network 144. Communication network 142 is implemented as any suitable system or collection of systems for connecting wireless carrier system 140 to MVCU 110 and land network 144.

Land network 144 connects communication network 142 to client computer 150, web-hosting portal 160, and call center 170. In one embodiment, land network 144 is a public-switched telephone network (PSTN). In another embodiment, land network 144 is implemented as an Internet protocol (IP) network. In other embodiments, land network 144 is implemented as a wired network, an optical network, a fiber network, other wireless networks, or any combination thereof. Land network 144 is connected to one or more landline telephones. Communication network 142 and land network 144 connect wireless carrier system 140 to web-hosting portal 160 and call center 170.

Client, personal or user computer 150 includes a computer usable medium to execute Internet browser and Internet-access computer programs for sending and receiving data over land network 144 and optionally, wired or wireless communication networks 142 to web-hosting portal 160. Personal or client computer 150 sends user preferences to web-hosting portal through a web-page interface using communication standards such as hypertext transport protocol (HTTP), and transport-control protocol and Internet protocol (TCP/IP). In one embodiment, the data includes directives to change certain programming and operational modes of electronic and mechanical systems within MVCU 110.

In operation, a client utilizes computer 150 to initiate setting or re-setting of user-preferences for MVCU 110. In an example, a client utilizes computer 150 to initiate a restricted use mode (e.g. a low-power mode) that telematics unit 120 in MVCU 110 operates within for a user specified period of time. User-preference data from client-side software is transmitted to server-side software of web-hosting portal 160. User-preference data is stored at web-hosting portal 160.

Web-hosting portal 160 includes one or more data modems 162, one or more web servers 164, one or more databases 166, and a network system 168. Web-hosting portal 160 is connected directly by wire to call center 170, or connected by phone lines to land network 144, which is connected to call center 170. In an example, web-hosting portal 160 is connected to call center 170 utilizing an IP network. In this example, both components, web-hosting portal 160 and call center 170, are connected to land network 144 utilizing the IP network. In another example, web-hosting portal 160 is connected to land network 144 by one or more data modems 162. Land network 144 sends digital data to and from modem 162, data that is then transferred to web server 164. Modem 162 may reside inside web server 164. Land network 144 transmits data communications between web-hosting portal 160 and call center 170.

Web server 164 receives user-preference data from user computer 150 via land network 144. In alternative embodiments, computer 150 includes a wireless modem to send data to web-hosting portal 160 through a wireless communication network 142 and a land network 144. Data is received by land network 144 and sent to one or more web servers 164. In one embodiment, web server 164 is implemented as any suitable hardware and software capable of providing web services to help change and transmit personal preference settings from a client at computer 150 to telematics unit 120 in MVCU 110. Web server 164 sends to or receives from one or more databases 166 data transmissions via network system 168. Web server 164 includes computer applications and files for managing and storing personalization settings supplied by the client, such as door lock/unlock behavior, radio station preset selections, climate controls, custom button configurations and theft alarm settings. For each client, the web server potentially stores hundreds of preferences for wireless vehicle communication, networking, maintenance and diagnostic services for a mobile vehicle.

In one embodiment, one or more web servers 164 are networked via network system 168 to distribute user-preference data among its network components such as database 166. In an example, database 166 is a part of or a separate computer from web server 164. Web server 164 sends data transmissions with user preferences to call center 170 through land network 144.

Call center 170 is a location where many calls are received and serviced at the same time, or where many calls are sent at the same time. In one embodiment, the call center is a telematics call center, facilitating communications to and from telematics unit 120 in MVCU 110. In an example, the call center is a voice call center, providing verbal communications between an advisor in the call center and a subscriber in a mobile vehicle. In another example, the call center contains each of these functions. In other embodiments, call center 170 and web-hosting portal 160 are located in the same or different facilities.

In an example, a client utilizes telematics unit 120 in MVCU 110 to communicate with an advisor in call center 170 to initiate a restricted use mode (e.g. a low-power mode) that telematics unit 120 in MVCU 110 operates within for a user specified period of time. In another example, a client utilizes land network 144 (e.g. a land line) to communicate with an advisor in call center 170 to initiate a restricted use mode (e.g. a low-power mode) that telematics unit 120 in MVCU 110 operates within for a user specified period of time.

Call center 170 contains one or more voice and data switches 172, one or more communication services managers 174, one or more communication services databases 176, one or more communication services advisors 178, and one or more network systems 180.

Switch 172 of call center 170 connects to land network 144. Switch 172 transmits voice or data transmissions from call center 170, and receives voice or data transmissions from telematics unit 120 in MVCU 110 through wireless carrier system 140, communication network 142, and land network 144. Switch 172 receives data transmissions from and sends data transmissions to one or more web-hosting portals 160. Switch 172 receives data transmissions from or sends data transmissions to one or more communication services managers 174 via one or more network systems 180.

Communication services manager 174 is any suitable hardware and software capable of providing requested communication services to telematics unit 120 in MVCU 110. Communication services manager 174 sends to or receives from one or more communication services databases 176 data transmissions via network system 180. Communication services manager 174 sends to or receives from one or more communication services advisors 178 data transmissions via network system 180. Communication services database 176 sends to or receives from communication services advisor 178 data transmissions via network system 180. Communication services advisor 178 receives from or sends to switch 172 voice or data transmissions.

Communication services manager 174 provides one or more of a variety of services, including enrollment services, navigation assistance, directory assistance, roadside assistance, business or residential assistance, information services assistance, emergency assistance, communications assistance, and managing registration requests. Communication services manager 174 receives service-preference requests for a variety of services from the client via computer 150, web-hosting portal 160, and land network 144. Communication services manager 174 transmits user-preference and other data to telematics unit 120 in MVCU 110 through wireless carrier system 140, communication network 142, land network 144, voice and data switch 172, and network system 180. Communication services manager 174 stores or retrieves data and information from communication services database 176. Communication services manager 174 may provide requested information to communication services advisor 178.

In one embodiment, communication services advisor 178 is implemented as a real advisor. In an example, a real advisor is a human being in verbal communication with a user or subscriber (e.g. a client) in MVCU 110 via telematics unit 120. In another embodiment, communication services advisor 178 is implemented as a virtual advisor. In an example, a virtual advisor is implemented as a synthesized voice interface responding to requests from telematics unit 120 in MVCU 110.

Communication services advisor 178 provides services to telematics unit 120 in MVCU 110. Services provided by communication services advisor 178 include enrollment services, navigation assistance, real-time traffic advisories, directory assistance, roadside assistance, business or residential assistance, information services assistance, emergency assistance, communications assistance, and registration request management. Communication services advisor 178 communicate with telematics unit 120 in MVCU 110 through wireless carrier system 140, communication network 142, and land network 144 using voice transmissions, or through communication services manager 174 and switch 172 using data transmissions. Switch 172 selects between voice transmissions and data transmissions.

In operation, an incoming call is routed to telematics unit 120 within mobile vehicle 110 from call center 170. In one embodiment, the call is routed to telematics unit 120 from call center 170 via land network 144, communication network 142, and wireless carrier system 140.

Figure 2:
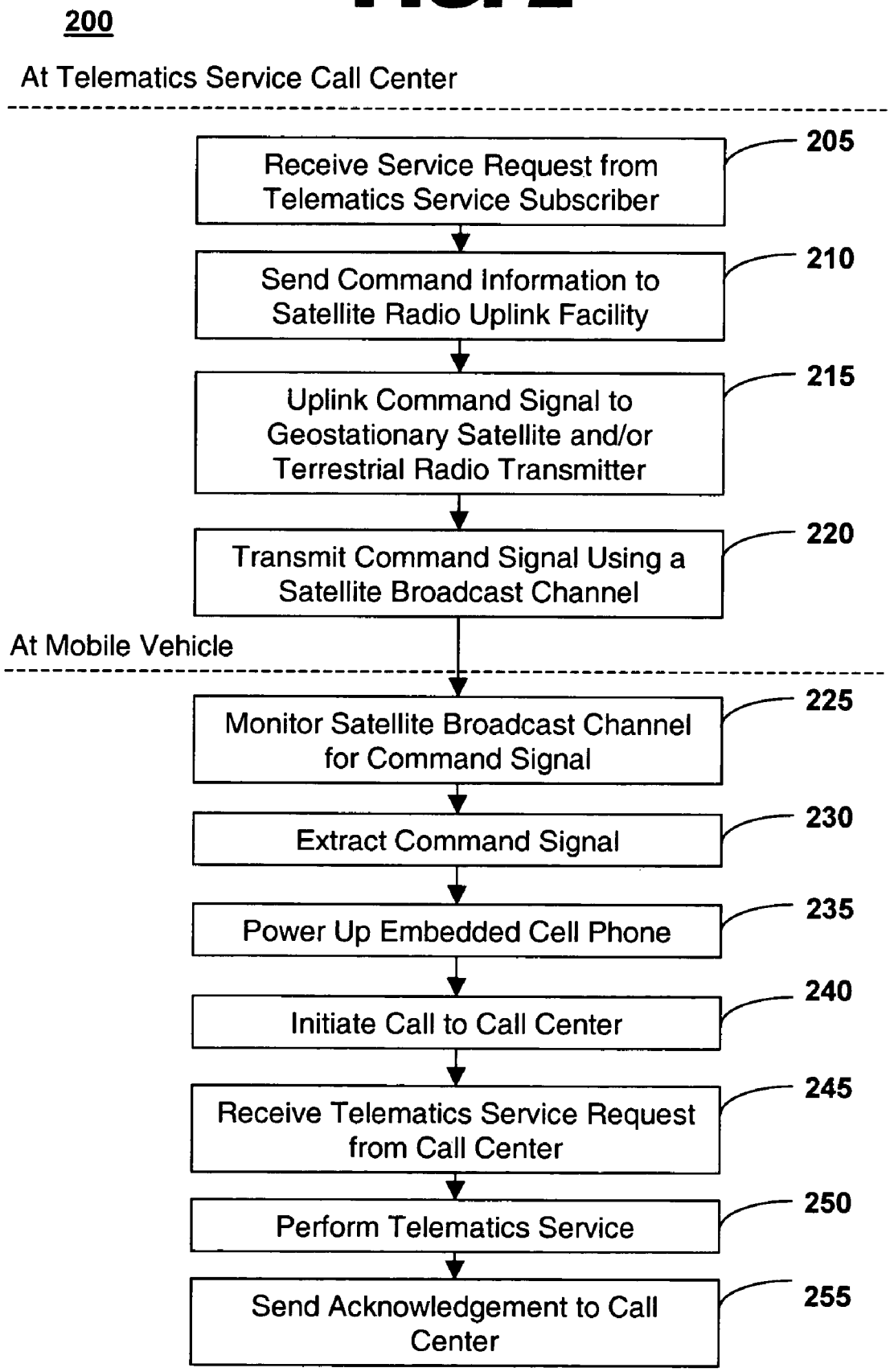
FIG. 2 is a flow diagram of one embodiment of a method for accessing a quiescent mobile vehicle equipped with a telematics unit and a satellite radio, in accordance with the current invention.

FIG. 2 illustrates one embodiment of a method for establishing communications with a quiescent mobile vehicle equipped with a telematics unit and a satellite radio receiver, in accordance with the present invention at 200. Quiescent mobile vehicle access method 200 sends a command signal in a satellite radio broadcast, which contains information that requests that a particular in-vehicle mobile phone call a telematics service call center.

A telematics service call center receives a service request from telematics service subscriber, as seen at block 205. A telematics service subscriber requests, for example, that the door of a vehicle be unlocked or that the vehicle's horn be honked and lights be flashed to help locate the vehicle in a large parking garage.

The telematics service call center sends command information to satellite radio uplink facility in response to the service request, as seen at block 210. The command information is sent to the satellite radio uplink facility over landline or wireless links. The information includes a request for the telematics unit of the vehicle to call the call center along with a telematics unit identifier associated with the vehicle for which a service has been requested. The telematics unit identifier is a vehicle identification number, a mobile phone identification number, an electronic serial number of the telematics unit, or a satellite radio receiver identification number associated with the satellite radio receiver.

The satellite radio uplink facility uplinks command information from a satellite radio uplink facility to a geostationary satellite, as seen at block 215. A computer application at a satellite radio uplink facility controls the sending of command signals that are received from telematics service call centers. The satellite radio uplink facility also uplinks command information to a terrestrial radio transmitter for local or metropolitan broadcasts, as seen at block 215. Satellite radio terrestrial radio transmitters receive radio signals from a geostationary satellite, amplify the signals, and rebroadcast the signals.

The command signal is transmitted in a satellite radio broadcast from one of a geostationary satellite and a terrestrial radio transmitter of a satellite radio service, as seen at block 220. The command signal is transmitted using a predetermined broadcast channel. The command signal is transmitted, for example, over a spectrum allocated for nationwide broadcasting of satellite-based DARS. The geostationary satellite transmits radio signals with data to a satellite radio receiver in the mobile vehicle.

A satellite radio system broadcast channel is monitored by a computer application in the DSP of the telematics unit for a command signal, as seen at block 225. The command signal for the designated vehicle includes a telematics unit identifier, identifying the vehicle for which a service has been requested. The command signal is extracted from the broadcast channel, as seen at block 230. The broadcast channel is monitored for particular command strings or protocol, and the command signal is extracted for further processing when a particular telematics unit identifier is ascertained. The command signal includes a telematics unit identifier, which is a vehicle identification number, a mobile phone identification number, an electronic serial number, or a satellite radio receiver identification number. The command signal includes a directive for the telematics unit to awaken from a sleep mode. The command signal indicates to the telematics unit that the in-vehicle mobile phone should place a call to a predetermined telephone number of the telematics service call center. The in-vehicle or embedded cell phone then is powered-up based on the command signal, as seen at block 235. The telematics unit initiates a call from the in-vehicle cell phone to a telematics service call center in response to the command signal, as seen at block 240. The cell phone remains powered up for a predetermined time period before returning to a quiescent state to ensure that the call center service request is completed and that there are no additional service requests pending. The cell phone operates in one of an analog mode or a digital mode.

The telematics service call center receives the call from the mobile phone in the mobile vehicle for which a telematics subscriber has requested service, and then the telematics service center sends back a service request. The telematics unit receives the telematics service request from the telematics service call center, as seen at block 245, after which the digital signal processor in the telematics unit initiates or controls the response to the telematics service request in the mobile vehicle, as seen at block 250. The telematics service includes, for example, unlocking doors, honking a horn, reading the GPS location of the vehicle, or flashing the headlights. The service is needed, for example, when an owner needs to locate the vehicle in a large parking garage and the honking of the car and the flashing of the headlights helps identify the location of the car. The telematics service is, for example, to send the current GPS location of a stolen vehicle, which helps law enforcement authorities in retrieving the vehicle.

After the telematics service has been completed, the telematics unit, optionally, sends to the call center an acknowledgement of receiving the request and of completing the service, as seen at block 255. The cell phone remains powered up for a predetermined time period to insure that the call center has no additional requests for the mobile vehicle before returning to a quiescent state.

Figure 3:
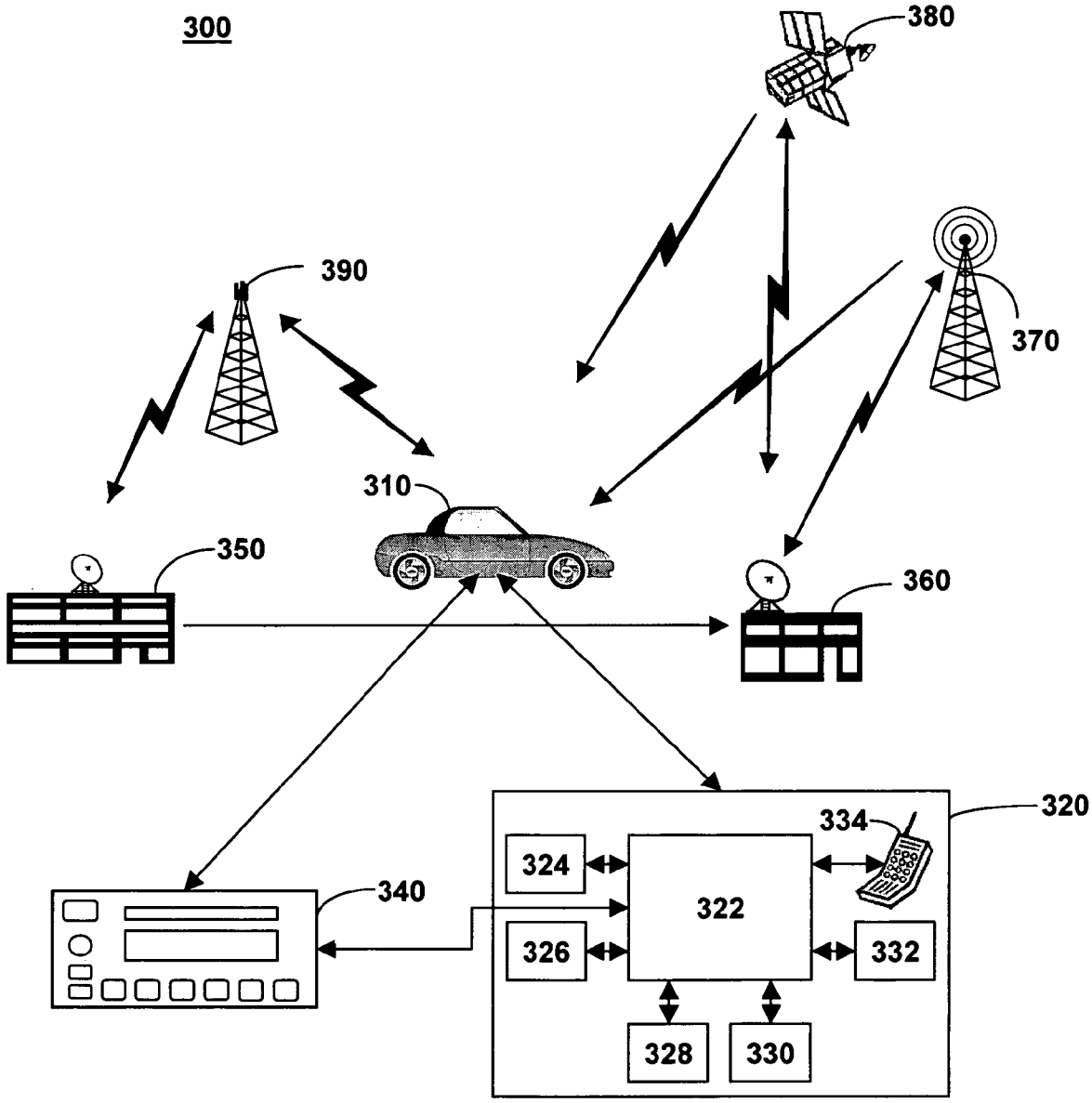
FIG. 3 is an illustration of one embodiment of a system for initiating a vehicle data upload at a plurality of mobile vehicles, in accordance with the current invention.

FIG. 3 illustrates one embodiment of a system for initiating a vehicle data upload function at a plurality of mobile vehicles, in accordance with the present invention at 300. The invention leverages the infrastructure of a satellite radio system to communicate with a plurality of mobile vehicles and instruct the telematics units in the vehicles to perform a vehicle data upload function. A call center initiates a vehicle data upload command signal and broadcasts the vehicle data upload command signal over a satellite radio channel. Satellite radios in the mobile vehicles monitor a broadcast channel and receive a broadcasted message requesting performance of the vehicle data upload function.

Vehicle data upload function initiation system 300 includes a plurality of mobile vehicles 310. Each mobile vehicle comprises a telematics unit 320, a satellite radio receiver 340, one or more call centers 350, one or more satellite radio service uplink facilities 360, one or more terrestrial radio transmitters 370, one or more satellite radio service geostationary satellites 380, a cellular phone network, and a wireless carrier system 390.

The plurality of mobile vehicles 310 is a group of vehicles equipped with suitable hardware and software for transmitting and receiving voice and data communications. The telematics unit 320 of each vehicle includes a DSP 322 connected to a wireless analog, digital or dual-mode modem 324, a global positioning system (GPS) unit 326, an in-vehicle memory 328, a microphone 330, one or more speakers 332, and a network access device (NAD) or in-vehicle mobile phone 334. In-vehicle mobile phone 334 is an analog, digital, or dual-mode cellular phone. GPS unit 326 provides, for example, longitude and latitude coordinates of the vehicle.

DSP 322 uses instructions and data from a computer usable medium that contain various computer programs for controlling programming and operational modes within each vehicle of the plurality of mobile vehicles 310. Digital signals activate the programming mode and operation modes, as well as provide input and output data.

Satellite radio receiver 340 is any suitable hardware for receiving satellite radio broadcast signals in each vehicle of the plurality of mobile vehicles 310. Satellite radio receiver 340 receives digital signals from a terrestrial radio transmitter 370 or a satellite radio service geostationary satellite 380. Satellite radio receiver 340 includes a radio receiver for receiving broadcast radio information over one or more channels. Satellite radio receiver 340 generates audio output. Satellite radio receiver 340 can be embedded within telematics unit 320 or can be a separate component connected to the telematics unit 320, as shown. Satellite radio receiver 340 provides channel and signal information to telematics unit 320. Telematics unit 320 monitors, filters and sends signals that are received from satellite broadcasts, radio broadcasts or other wireless communication systems to output devices such as speaker 332 and visual display devices.

Call center 350 is a location where many calls are received and serviced at the same time, or where many calls are sent at the same time. The call center prescribes communications to and from the plurality of mobile vehicles 310. In one embodiment of the invention, the call center is a telematics call center, facilitating communications to and from telematics unit 320 in each vehicle of the plurality of mobile vehicles 310. In another embodiment of the invention, call center 350 is a voice call center, providing verbal communications between an advisor in the call center and a subscriber in each vehicle of the plurality of mobile vehicles. In another embodiment of the invention, call center 350 contains each of these functions. Call center 350 contains one or more switches, one or more data transmission devices, one or more communication services managers, one or more communication services databases, one or more real or virtual advisors, and one or more bus systems.

When call center 350 initiates a vehicle data upload function in a plurality of mobile vehicles, call center 350 sends command information to satellite radio uplink facility 360. The command information includes a request for the telematics unit 320 in each vehicle of the plurality of mobile vehicles to perform a vehicle data upload function.

As part of a satellite broadcast system, a satellite radio uplink facility 360 sends and receives radio signals from a geostationary satellite 380. Satellite radio uplink facility 360 transmits command information from call center 350 to one or more terrestrial radio transmitters 370. Satellite radio uplink facility 360 also sends the command information and other radio signals to geostationary satellite 380.

Terrestrial radio transmitter 370 and geostationary satellite 380 transmits radio signals to satellite radio receiver 340 in each vehicle of the plurality of mobile vehicles 310. Terrestrial radio transmitter 370 and geostationary satellite 380 broadcasts, for example, over a spectrum in the "S" band (2.3 GHz) that has been allocated by the U.S. Federal Communications Commission (FCC) for nationwide broadcasting of satellite-based DARS. The broadcast is, for example, a 120 kilobyte-per-second portion of the bandwidth designated for command signals from call center 350 to the plurality of mobile vehicles 310.

Broadcast transmissions provided by a satellite radio broadcast system is sent from geostationary satellite 380 or terrestrial radio transmitter 370 to satellite radio receiver 340 in each vehicle. In addition to music and entertainment, traffic information, road construction information, advertisements, news and information on local events, a vehicle data upload command signal is sent to satellite radio receiver 340 in each vehicle to instruct telematics unit 320 of each vehicle of the plurality of mobile vehicles to perform a vehicle data upload function. The vehicle data upload command signal comprises a plurality of telematics unit identifiers that identifies the mobile vehicles belonging to the plurality of mobile vehicles 310. Each telematics unit 320 monitors satellite radio system broadcast signals received by satellite radio receiver 340 for the vehicle data upload command signal and a telematics unit identifier that corresponds to the vehicle. When a corresponding telematics unit identifier and the vehicle data upload command signal are detected, the vehicle data upload command signal and information is extracted from the broadcast channel.

In one embodiment of the invention, the vehicle data upload command signal includes a request for the telematics unit 320 in each vehicle of the plurality of mobile vehicles to initiate a vehicle data upload call to call center 350 thereby allowing the call center to pull stored vehicle data. In response, telematics unit 320 places a vehicle data upload call with in-vehicle mobile phone 334 via wireless carrier system 390. In another embodiment of the invention, vehicle data upload command signal includes a request for the telematics unit 320 in each vehicle of the plurality of mobile vehicles to initiate a vehicle data storage, for future upload of the vehicle data type to call center 350.

Wireless carrier system 390 is a wireless communications carrier. Wireless carrier system 390 is, for example, a mobile telephone system. The mobile telephone system is an analog mobile telephone system operating over a prescribed band nominally at 800 MHz. The mobile telephone system is a digital mobile telephone system operating over a prescribed band nominally at 800 MHz, 900 MHz, 1900 MHz, or any suitable band capable of carrying mobile communications. Wireless carrier system 390 transmits signals to and receives signals from the plurality of mobile vehicles 310. Wireless carrier system 390 is connected with other communication and landline networks. Call center 350 is connected to wireless carrier system 390 with a land-based network, a wireless network, or a combination of landline and wireless networks.

Figure 4:
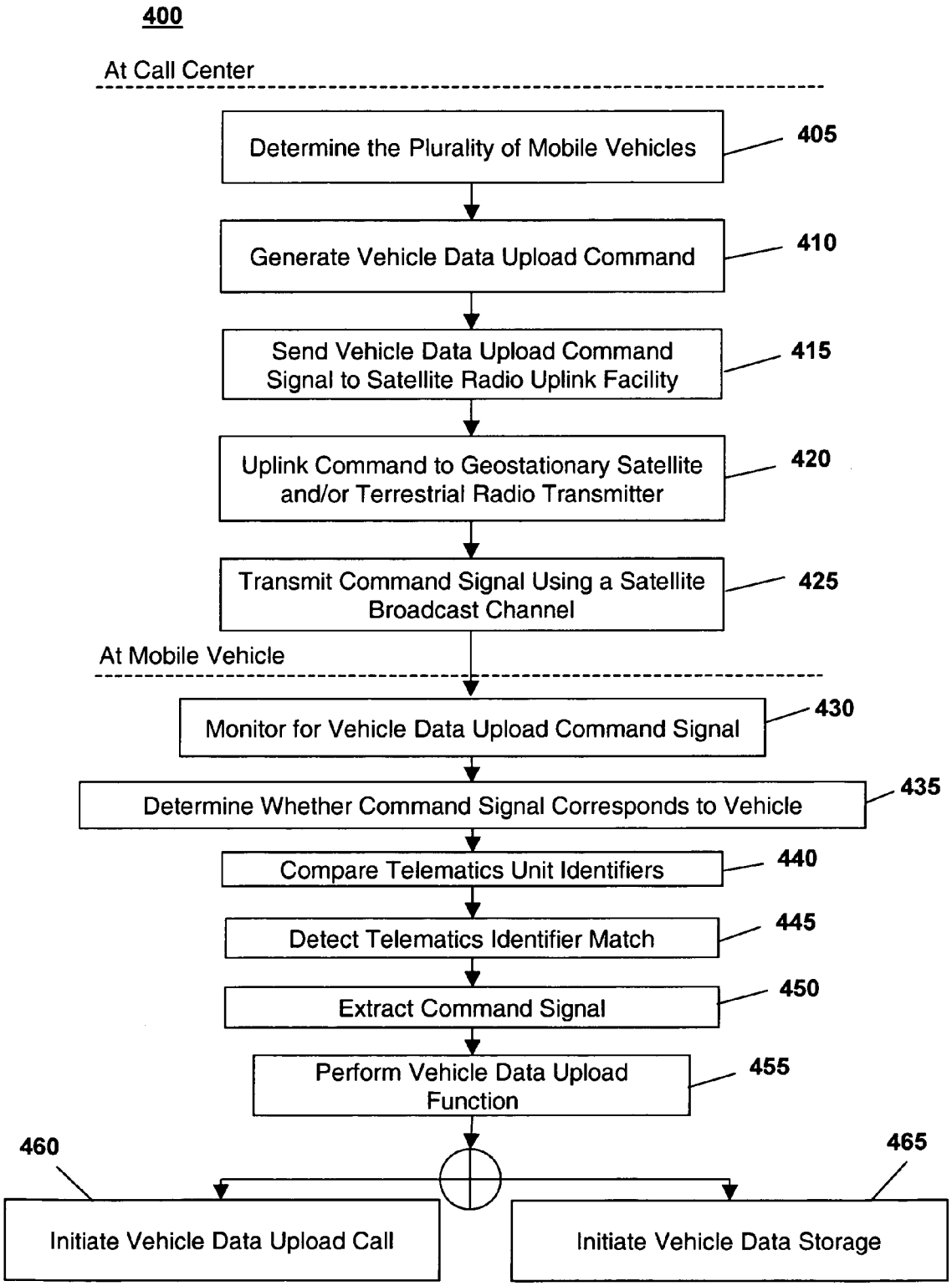
FIG. 4 is a flow diagram of one embodiment of a method for initiating a vehicle data upload function at a plurality of mobile vehicles, in accordance with the current invention.

FIG. 4 shows one embodiment of a method for processing vehicle data at a plurality of mobile vehicles, in accordance with the present invention at 400. Processing vehicle data at a plurality of mobile vehicles method 400 comprises steps to send a vehicle data upload command signal in a satellite radio broadcast, which contains information that requests a plurality of mobile vehicles perform a vehicle data upload function.

Each vehicle is equipped with a telematics unit and a satellite radio receiver. Vehicle related information is automatically stored and uploaded to a call center upon the occurrence of specified events in a vehicle. Internal triggers such as miles traveled, engine running time, or number of ignition events are used to initiate the upload of any of a number of vehicle parameters. An external trigger is useful in balancing peak call times so that the number of vehicles placing calls to a call center is more uniformly dispersed over time. The external trigger is also useful in allowing a group of vehicles to capture data simultaneously, such as, at a specific time or at the occurrence of a geographic based diagnostic event.

The call center determines the plurality of mobile vehicles based on service criteria (block 405). Examples of service criteria used by the call center comprise a vehicle performance issue associated with a group of mobile vehicles, a particular mobile vehicle model, an environmental condition in a geographic area, or a maintenance bulletin issued for a group of mobile vehicles. The call center generates vehicle data upload command signals for a plurality of mobile vehicles in response to various events. An example of an event that prompts the call center to initiate a vehicle data upload command signal is a geographic based diagnostic event. A geographic based diagnostic event is the occurrence of various factors in a particular geographic area that affect the performance, reliability, or operability of a group of mobile vehicles. Those factors include, for example, extreme temperatures, high humidity, or dusty conditions. The call center also generates vehicle data upload command signals for a plurality of mobile vehicles to for use in providing maintenance or warranty related services. The vehicle data upload command signal comprises a vehicle data type, such as an air mixture ratio, or oxygen sensor reading, of interest to the call center.

The call center initiates the vehicle data upload command signal by generating the vehicle data upload command signal (block 410) and sending the vehicle data upload command signal to the satellite radio uplink facility (block 415). The vehicle data upload command signal is sent to the satellite radio uplink facility over landline or wireless links. The command includes a request for the telematics unit of each mobile vehicle in the plurality of mobile vehicles to perform a vehicle data upload function along with a telematics unit identifier associated with each mobile vehicle in the plurality of mobile vehicles. The call center includes the telematics unit identifiers of the vehicles from which data is required. Examples of telematics unit identifiers are: a vehicle identification number, a mobile phone identification number, an electronic serial number of the telematics unit, or a satellite radio receiver identification number associated with the satellite radio receiver.

The vehicle data upload command is associated with a vehicle type, for example vehicle model or engine manufacture. Other factors such as geographic location are also used in generating the vehicle data upload command.

The satellite radio uplink facility transmits vehicle data upload commands from a satellite radio uplink facility to a geostationary satellite (block 420). A computer application at a satellite radio uplink facility controls the sending of vehicle data upload command signals received from the call center. The satellite radio uplink facility also transmits vehicle data upload commands to a terrestrial radio transmitter for local or metropolitan broadcasts. Satellite radio terrestrial radio transmitters receive radio signals from a geostationary satellite, amplify the signals, and rebroadcast the signals.

The vehicle data upload command signal is transmitted in a satellite radio broadcast from one of a geostationary satellite and/or a terrestrial radio transmitter of a satellite radio service (block 425). The vehicle data upload command signal is transmitted using a predetermined broadcast channel. The vehicle data upload command signal is transmitted, for example, over a spectrum allocated for nationwide broadcasting of satellite-based DARS. Geostationary satellite transmits radio signals with data to a satellite radio receiver in the mobile vehicle.

A satellite radio system broadcast channel is monitored by a computer application in the DSP of the telematics unit for a vehicle data upload command signal (block 430). The vehicle data upload command signal for the designated vehicles include a plurality of telematics unit identifiers, identifying the mobile vehicles that are to perform the vehicle data upload function. The mobile vehicles determine whether the vehicle data upload command signal corresponds to the mobile vehicle (block 435). The determination is made by comparing the plurality of telematics unit identifiers of the vehicle data upload command signal to the telematics unit identifier of the mobile vehicle (block 440) and detecting if one of the plurality of telematics unit identifiers of the vehicle data upload command signal matches the telematics unit identifier of the mobile vehicle (block 445). The vehicle data upload command signal is extracted from the broadcast channel (block 450). The broadcast channel is monitored for particular command strings or protocol, and the vehicle data upload command signal is extracted for further processing when a particular telematics unit identifier is detected. The vehicle data upload command signal includes a telematics unit identifier, which is a vehicle identification number, a mobile phone identification number, an electronic serial number, or a satellite radio receiver identification number. The vehicle data upload command signal comprises instructions for the telematics unit to perform a vehicle data upload function (block 455).

The vehicle data upload function comprises initiating a vehicle data upload call (block 460) or initiating a vehicle data storage (block 465). The vehicle data upload call occurs when the vehicle data upload command signal directs the telematics unit to place a cell phone call to the call center so that the call center can pull a stored vehicle data. The stored vehicle data is a vehicle data type, such as, vehicle performance data, vehicle diagnostic data, vehicle status data, or vehicle operational data. The vehicle data storage occurs when the vehicle data upload command signal directs the telematics unit to store vehicle data, of a particular vehicle data type, for upload to the call center at a future time.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A method of initiating a vehicle data upload function at a plurality of mobile vehicles, the method comprising:

monitoring a radio system broadcast channel using a satellite radio receiver in each of the plurality of mobile vehicles for a call center initiated vehicle data upload command signal sent to the plurality of mobile vehicles; and, for each of plurality of mobile vehicles, determining whether the vehicle data upload command signal corresponds to that mobile vehicle;

extracting the vehicle data upload command signal from the broadcast channel based on the determination;

communicating the vehicle data upload command signal between the satellite radio receiver and a telematics unit on the vehicle; and performing a vehicle data upload function using the telematics unit based on the extracted vehicle data upload command signal.

2. The method of claim 1 further comprising:

determining the plurality of mobile vehicles at a call center based on a service criterion.

3. The method of claim 1 wherein the vehicle data upload function comprises a vehicle data type.

4. The method of claim 1 wherein the vehicle data upload command signal comprises at least one telematics unit identifier.

5. The method of claim 1 wherein performing the vehicle data upload function comprises:

initiating a vehicle data upload call from a telematics unit in the plurality of mobile vehicles to a call center in response to the vehicle data upload command signal.

6. The method of claim 1 wherein performing the vehicle data upload function comprises:

initiating a vehicle data storage of data collected by the vehicle in at least one of the plurality of mobile vehicles in response to the vehicle data upload command signal.

7. The method of claim 1 wherein the vehicle data upload command signal is associated with a vehicle type.

8. The method of claim 1 wherein the vehicle data upload command signal is generated in response to a geographic based diagnostic event.

9. The method of claim 3 wherein the vehicle data type is selected from a group consisting of vehicle performance data, vehicle diagnostic data, vehicle status data, and vehicle operational data.

10. The method of claim 1 wherein determining at the plurality of mobile vehicles whether the vehicle data upload command signal corresponds to the mobile vehicle comprises:

comparing the plurality of telematics unit identifiers of the vehicle data upload command signal to a telematics unit identifier the mobile vehicle; and detecting if one of the plurality of telematics unit identifiers of the vehicle data upload command signal matches the telematics unit identifier of the mobile vehicle.

11. A computer readable medium including a stored computer program code for initiating a vehicle data upload function at a plurality of mobile vehicles, comprising:

computer program code for monitoring a radio system broadcast channel using a satellite radio receiver to detect a call center initiated vehicle data upload command signal sent to the plurality of mobile vehicles; and, for each of plurality of mobile vehicles, computer program code for determining at each of the plurality of mobile vehicles whether the vehicle data upload command signal corresponds to that mobile vehicle;

computer program code for extracting the vehicle data upload command signal from the broadcast channel based on the determination;

computer program code for communicating the vehicle data upload command signal between the satellite radio receiver and a telematics unit on the vehicle; and computer program code for performing a vehicle data upload function using the telematics unit based on the extracted vehicle data upload command signal.

12. The computer readable medium of claim 11 further comprising:

computer program code for determining the plurality of mobile vehicles at a call center based on a service criterion.

13. The computer readable medium of claim 11 wherein computer program code for performing the vehicle data upload function comprises:

computer program code for initiating a vehicle data upload call from a telematics unit in the plurality of mobile vehicles to a call center in response to the vehicle data upload command signal.

14. The computer readable medium of claim 11 wherein computer program code for performing the vehicle data upload function comprises:

computer program code for initiating a vehicle data storage in the plurality of mobile vehicles in response to the vehicle data upload command signal.

15. The computer readable medium of claim 11 wherein computer program code for determining at the plurality of mobile vehicles whether the vehicle data upload command signal corresponds to the mobile vehicle comprises:

computer program code for comparing the plurality of telematics unit identifiers of the vehicle data upload command signal to a telematics unit identifier the mobile vehicle; and computer program code for detecting if one of the plurality of telematics unit identifiers of the vehicle data upload command signal matches the telematics unit identifier of the mobile vehicle.

16. A system including means for initiating a vehicle data upload function at a plurality of mobile vehicles, comprising:

means for monitoring a radio system broadcast channel using a satellite radio receiver in each of the plurality of mobile vehicles for a call center initiated vehicle data upload command signal sent to the plurality of mobile vehicles;

means for determining at the plurality of mobile vehicles whether the vehicle data upload command signal corresponds to that mobile vehicle;

means for extracting the vehicle data upload command signal from the broadcast channel based on the determination;

means for communicating the vehicle data upload command signal between the satellite radio receiver and a telematics unit on the vehicle; and means for performing a vehicle data upload function using the telematics unit based on the extracted vehicle data upload command signal.

17. The system of claim 16 further comprising:

means for determining the plurality of mobile vehicles at a call center based on a service criterion.

18. The system of claim 16 wherein means for performing the vehicle data upload function comprises:

means for initiating a vehicle data upload call from a telematics unit in the plurality of mobile vehicles to a call center in response to the vehicle data upload command signal.

19. The system of claim 16 wherein means for performing the vehicle data upload function comprises:

means for initiating a vehicle data storage in the plurality of mobile vehicles in response to the vehicle data upload command signal.

20. The system of claim 16 wherein means for determining at the plurality of mobile vehicles whether the vehicle data upload command signal corresponds to the mobile vehicle comprises:

means for comparing the plurality of telematics unit identifiers of the vehicle data upload command signal to a telematics unit identifier the mobile vehicle; and means for detecting if one of the plurality of telematics unit identifiers of the vehicle data upload command signal matches the telematics unit identifier of the mobile vehicle.

* * * * *